US006628241B1

(12) United States Patent
Fukushima et al.

(10) Patent No.: US 6,628,241 B1
(45) Date of Patent: Sep. 30, 2003

(54) ANTENNA DEVICE AND COMMUNICATION TERMINAL COMPRISING THE SAME

(75) Inventors: Susumu Fukushima, Osaka (JP); Yuki Satoh, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/831,952

(22) PCT Filed: Sep. 13, 2000

(86) PCT No.: PCT/JP00/06238

§ 371 (c)(1),
(2), (4) Date: Aug. 8, 2001

(87) PCT Pub. No.: WO01/20715

PCT Pub. Date: Mar. 22, 2001

(30) Foreign Application Priority Data

Sep. 16, 1999 (JP) ..... 11-262124

(51) Int. Cl.[7] ..... H01Q 1/24; H01Q 1/36
(52) U.S. Cl. ..... 343/895; 343/702
(58) Field of Search ..... 343/895, 702

(56) References Cited

U.S. PATENT DOCUMENTS 4,160,979 A 7/1979 Drewett ..... 343/895

FOREIGN PATENT DOCUMENTS

| | | |
|---|---|---|
| EP | 0 893 841 | 1/1999 |
| JP | 5-275919 | 10/1993 |
| JP | 6-53730 | 2/1994 |
| JP | 7-302716 | 11/1995 |
| JP | 8-78946 | 3/1996 |
| JP | 9-326627 | 12/1997 |
| JP | 10-242740 | 9/1998 |
| JP | 10-322122 | 12/1998 |

*Primary Examiner*—Michael C. Wimer
(74) *Attorney, Agent, or Firm*—McDermott, Will & Emery

(57) ABSTRACT

The present invention relates to an antenna mainly used in a cellular phone or the like and to a communication terminal using it. It is hence an object thereof to realize an antenna having a high radiation efficiency, a wide adjustable range of the impedance of the antenna, and a capability of matching with an RF circuit by the structure itself without using a matching circuit. The number of structural parameters for adjusting the impedance of the antenna increases. To achieve the object, the antenna in the communication terminal of the present invention has a radiation element wound spirally around an insulating core in the winding direction inverted at an arbitrary position. The antenna is hence capable of adjusting the impedance, and as a result, the number of structural parameters of the antenna increases, and the adjustable range of the impedance of the antenna is expanded.

26 Claims, 11 Drawing Sheets

ANTENNA DEVICE AND COMMUNICATION TERMINAL COMPRISING THE SAME

TECHNICAL FIELD

The present invention relates to an antenna used in a cellular phone or the like, and a communication terminal using it.

BACKGROUND ART

Recently, communication terminals are widely and rapidly used for mobile communications with cellular phones, pagers, and so on.

FIG. 11 shows an example of a conventional antenna used in a communication terminal for mobile communications. In FIG. 11, the antenna is composed of a helical element 100 made of conductive material. One end of the element opens, and the other end is electrically connected to a metal plug 102 having a screw portion. The helical element 100 is encapsulated in a resin cover 101 to assure a mechanical strength and to prevent the metal material from corrosion.

The metal plug 102 is connected electrically with the screw portion driven into a screw hole 103 provided in a case 107. The screw hole 103 is electrically connected to a feeding land 105, which is disposed on the surface of an internal substrate 108, through a spring 104. The feeding land 105 is electrically connected to an RF circuit 106 through a microstrip line 109, so that a current may be fed into the helical element 100 through them.

In a method of radiating the signal supplied to the antenna efficiently as radio wave, it may be considered to eliminate an element loss in a matching circuit by omitting the matching circuit (not shown) which is necessary for matching between the antenna and RF circuit 106. For this purpose, however, the antenna has to be matched with the RF circuit with the structure of the antenna itself.

In the case of the antenna shown in FIG. 11, structural parameters of the antenna adjustable in the impedance include the element length, winding pitch width, and antenna diameter. The more structural parameters, the wider is the adjustable range of the impedance of the antenna, and therefore, that is beneficial for enhancing the radiation efficiency of the antenna.

Lately, in communication terminals for mobile communications, the system becomes more complex. An antenna operable for two frequency bands is required for the antenna for the terminal. To realize such antenna having an excellent radiation efficiency, the number of elements in the matching circuit must be reduced as much as possible. The antenna hence requires more structural parameters for adjusting the impedance of the antenna.

SUMMARY OF THE INVENTION

The invention is devised to solve the problems of the prior art, and it is hence an object thereof to provide an antenna having a high radiation efficiency, a widened adjustable range of the impedance, and a capability of matching with the RF circuit without using the matching circuit. The number of structural parameters increases for adjusting the impedance of the antenna.

To achieve the object, an antenna of the present invention and the communication terminal using it are capable of adjusting the impedance of the antenna itself by an inverted winding direction at an arbitrary position of a radiation element. The element wound spirally around an insulating core increases the number of structural parameters of the antenna and expands the adjustable range of the impedance of the antenna.

BEST MODE FOR CARRYING OUT THE INVENTION

Embodiment 1

Figure 1:
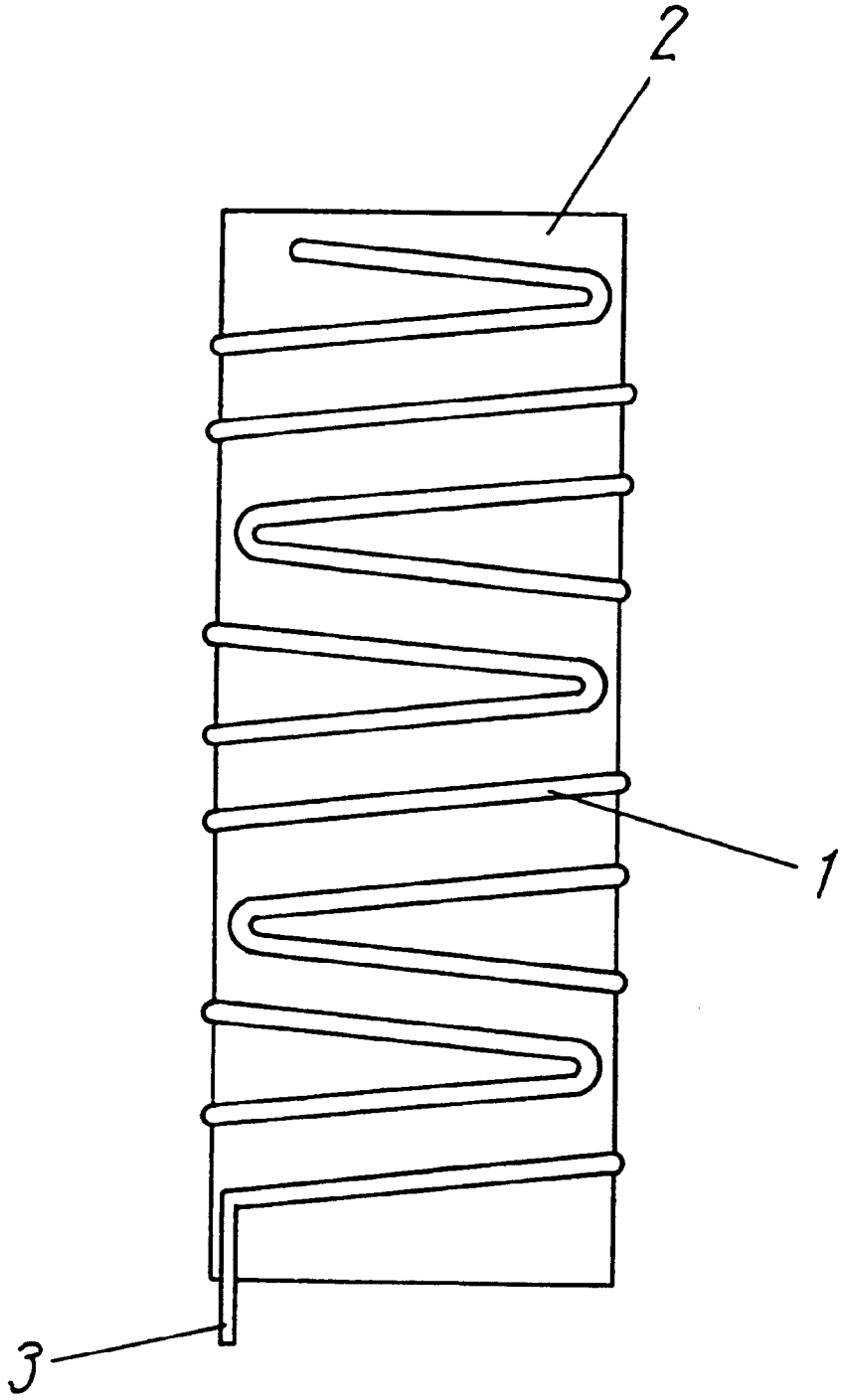
FIG. 1 is a structural diagram of a substantial portion of an antenna according to a first exemplary embodiment of the present invention.

FIG. 1 is a structural diagram of a substantial portion of an antenna in a first exemplary embodiment of the present invention. In FIG. 1, a radiation element 1 is formed on the surface of a columnar insulating resin core 2. Through a feeding terminal 3 at the lower end of the radiation element 1, a signal is supplied. The radiation element 1 is wound on the insulating resin core 2 at equal pitches from the feeding point 3 in the winding direction inverted at an arbitrary position.

Inverting the winding direction of the radiation element 1 at an arbitrary position changes the impedance characteristic of the antenna, so that the antenna may be matched by itself and designed without a matching circuit.

As a result, a power loss in the matching circuit can be suppressed, and an antenna having a high radiation efficiency is provided.

According to the embodiment, the winding direction is inverted regularly and however, may be inverted at random. The winding pitch according to the embodiment is equal and however, may be varied randomly or regularly. Varying the pitch at a portion where the current is distributed more intensively in the element changes the impedance of the antenna more effectively. As a result of the above operations, the adjustable range of the impedance of the antenna is expanded.

Embodiment 2

Figure 2:
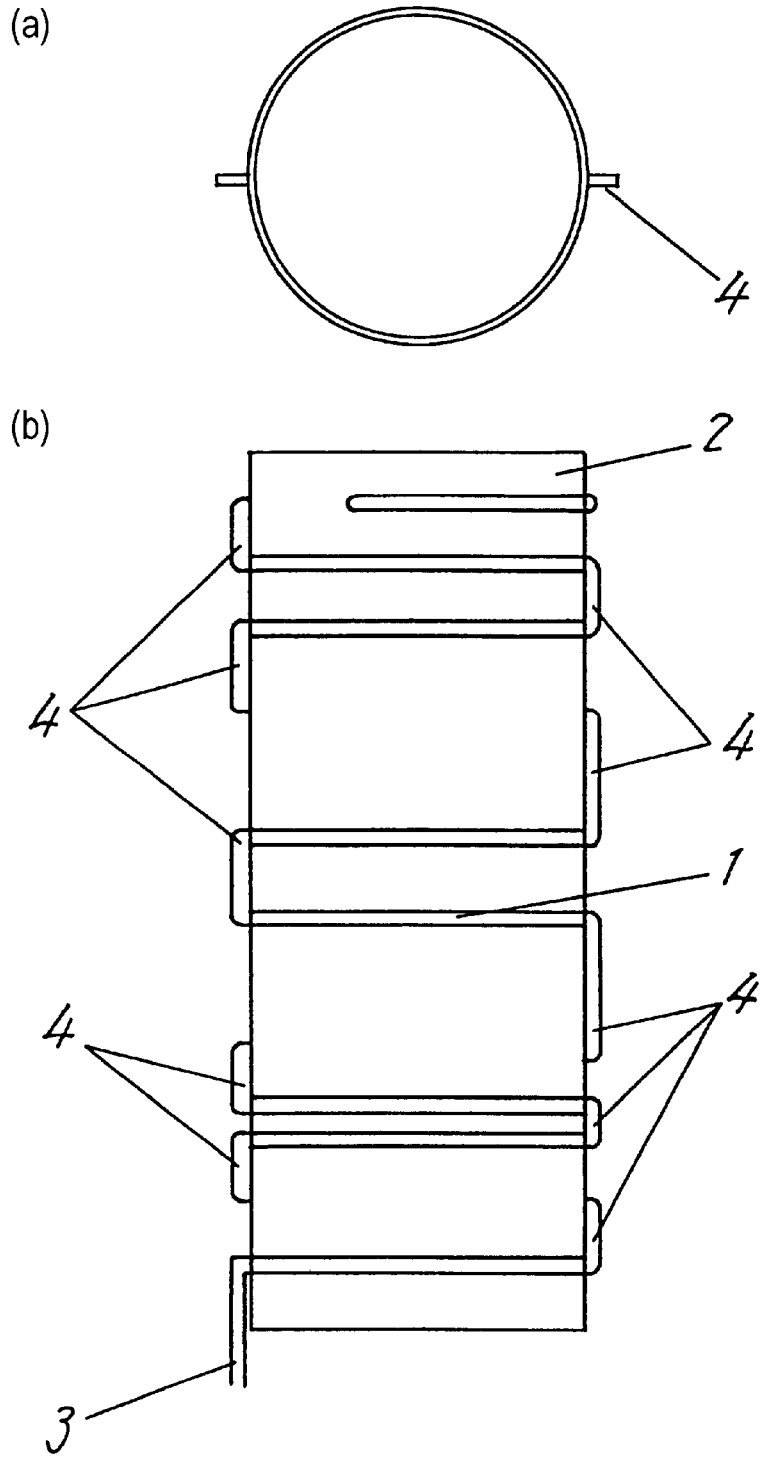
FIG. 2 is a structural diagram of a substantial portion of an antenna according to a second exemplary embodiment of the present invention.

FIG. 2 is a structural diagram of a substantial portion of an antenna in a second exemplary embodiment of the present invention. In FIG. 2 similarly to FIG. 1, a radiation element 1 is formed on the surface of a columnar insulating resin core 2. Through a feeding terminal 3 at the lower end of the radiation element 1, a signal is supplied.

For forming the radiation element 1, an element having an arbitrary length is provided in a substantially perpendicular direction from the feeding terminal 3, bent substantially in a horizontal direction, and wound clockwise in a half turn around the surface of the insulating resin core 2. Further, it is bent substantially in a perpendicular direction to form an element (a rib 4) of an arbitrary length. And then, it is bent again substantially in a horizontal direction and wound clockwise in a half turn around the surface of the insulating resin core 2. And then, it is bent substantially in a perpendicular direction to form an element (a rib 4) of an arbitrary length. Then, it is bent again substantially in a horizontal direction and wound clockwise in a half turn around the surface of the insulating resin core 2. Once more, it is bent nearly in a perpendicular direction, and an element (a rib 4) of an arbitrary length is provided, which is folded back nearly in a horizontal direction, and wound a half turn counterclockwise around the surface of the insulating resin core 2.

By such structure accumulated, on the surface of the insulating resin core 2, as shown in FIG. 2, the element is wound by 1.5 clockwise turns total, and then, by 1.5 counterclockwise turns total, and the structure is accumulated. Therefore, inverting the winding direction around the surface of the insulating resin core 2 at every 1.5 turns changes the impedance characteristic of the antenna, so that the antenna may not require a matching circuit.

With the structure of the antenna, when being manufactured, the antenna can be formed by a pressing work. That is, as shown in FIG. 2, the radiation element 1 has ribs 4 at two symmetrical points at the circular section of the element. Being pressed with a die from above and beneath with supported on the ribs 4, the element elongating substantially in a horizontal direction is formed into an arch shape. As a result, the antenna having an inverting structure may be manufactured automatically. The manufacturing efficiency is thus enhanced, and the manufacturing cost is reduced.

According to the embodiment, the winding direction is inverted regularly and may however be inverted at random. The winding pitch according to the embodiment is varied at winding positions and may however be wound at equal pitches.

Embodiment 3

Figure 3:
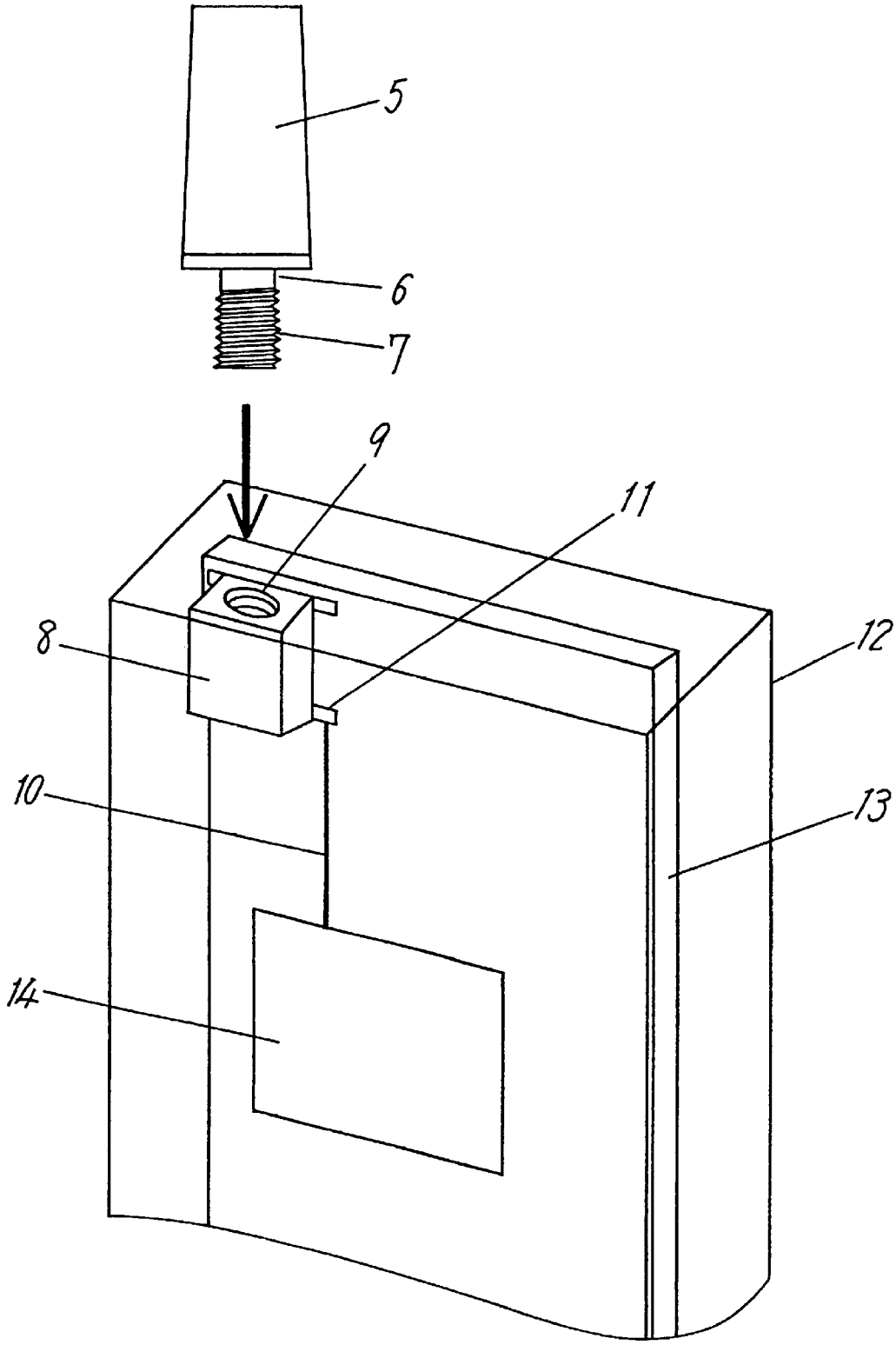
FIG. 3 is a perspective view of a communication terminal according to a third exemplary embodiment of the present invention.

FIG. 3 is a perspective view of a communication terminal according to a third exemplary embodiment of the present invention, which shows a method of mounting a antenna to a portable terminal. An antenna comprises an antenna unit 5 in the upper part and a metal plug 6 connected electrically to the antenna unit 5 in the lower part. The antenna is mounted on the top of a case 12 with a screw portion 7 at the lower end of the metal plug 5. The screw portion 7 is fixed into a screw hole 9 in an antenna fixing part 8.

The antenna fixing part 8 is mounted on an internal substrate 13 provided in the case 12, and an RF circuit 14 and a feeding terminal 11 are electrically connected through a microstrip line 10, through which a signal is supplied into the antenna.

The antenna device and RF circuit 14 are electrically connected securely with the antenna fixing part 8. And thus, even if the case 12 is dropped down, or even if an external pressure is applied to the case 12, the signal supplied to the antenna is hardly interrupted, and the communication terminal excellent in mechanical strength and high in reliability is provided.

Embodiment 4

Figure 4:
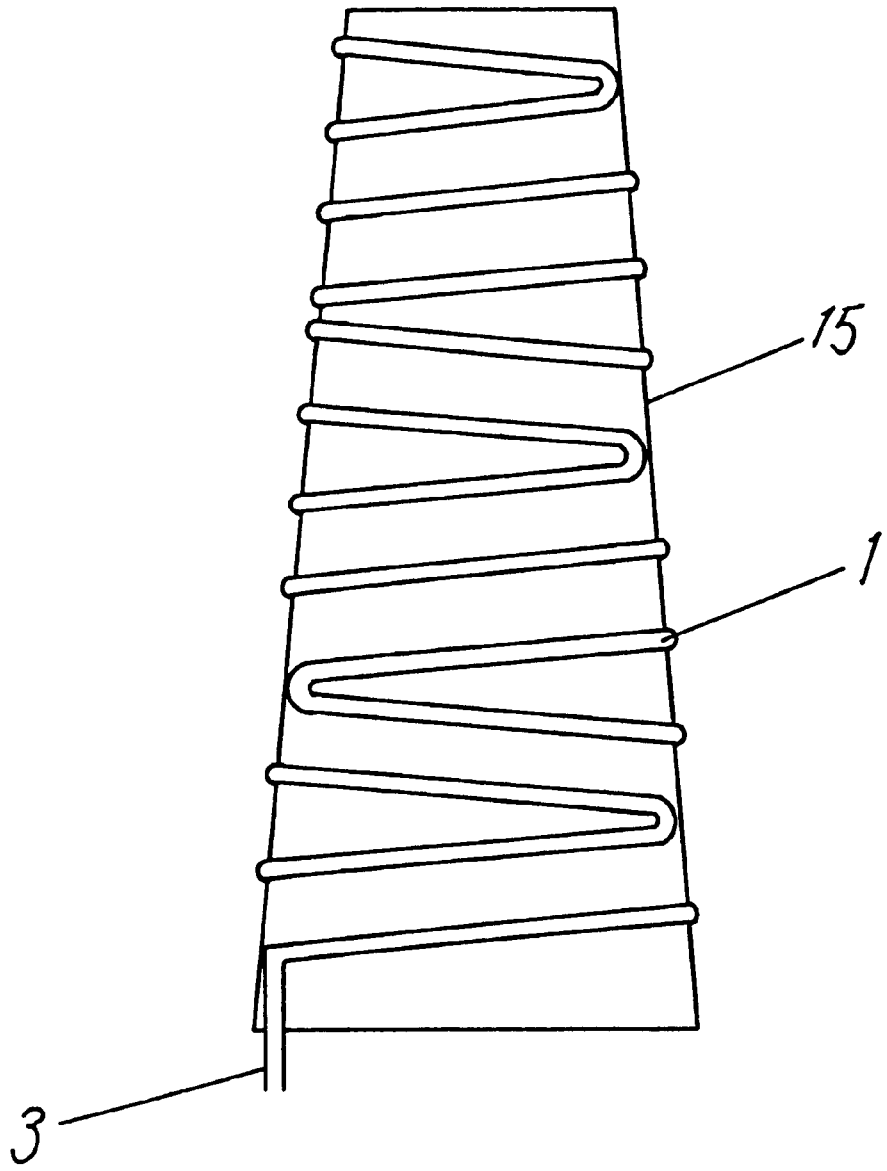
FIG. 4 is a structural diagram of a substantial portion of an antenna according to a fourth exemplary embodiment of the present invention.

FIG. 4 is a structural diagram of a substantial portion of an antenna according to a fourth exemplary embodiment of the present invention. In FIG. 4, an insulating resin core 15 has the diameter being gradually smaller from the lower part to the upper part. A radiation element 1 is formed on the surface, and a signal is supplied through a feeding terminal 3 at the lower end of the radiation element 1.

The radiation element 1 is wound on the surface of the insulating resin core 15 at equal pitches from the feeding terminal 3 in the winding direction inverted at an arbitrary position.

The fixed type antenna recently used in the communication terminal has mainly a shape becoming smaller in diameter to the leading end like the insulating resin core 15. The antenna shown in FIG. 4 is thus regarded to be one of the optimum one.

Embodiment 5

Figure 5:
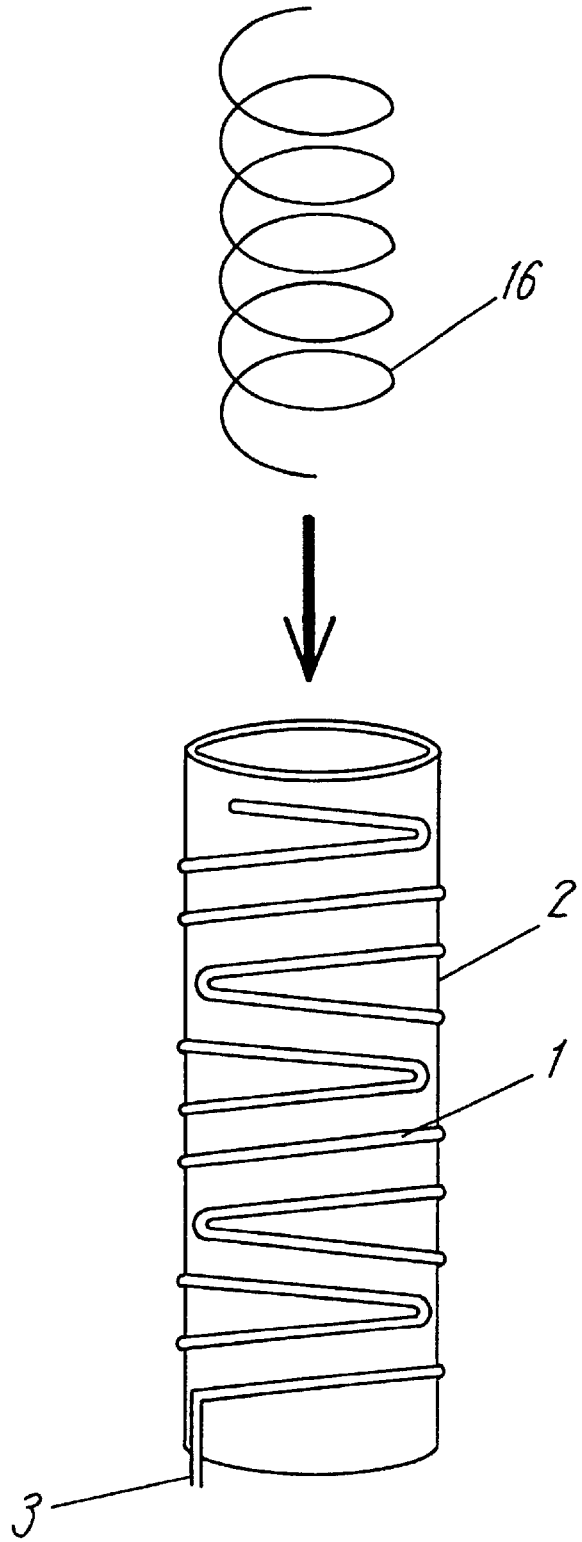
FIG. 5 is an exploded structural diagram of a substantial portion of an antenna according to a fifth exemplary embodiment of the present invention.

FIG. 5 is an exploded structural diagram of a substantial portion of an antenna according to a fifth exemplary embodiment of the present invention. In FIG. 5, radiation element 1 is formed on the surface of a columnar insulating resin core 2, and a signal is supplied through a feeding terminal 3 at the lower end of the radiation element 1. The radiation element 1 is wound on the surface of the insulating resin core 2 from the feeding terminal 3 in the winding direction inverted at an arbitrary position.

A columnar hole is formed in the center of the columnar insulating resin core 2. A helical element 16 is disposed at an arbitrary position of the hole with being insulated from the radiation element 1.

In the antenna, physical parameters capable of varying the impedance characteristics include the element length and pitch, the antenna diameter, the winding direction of the radiation element 1, and also the element length and pitch, of the antenna diameter of the helical element 16. The impedance characteristic of the antenna may be adjusted with the configuration of the radiation element 1 and helical element 16. The antenna has thus many parameters for adjusting the impedance characteristic and the adjustable range of the impedance. Therefore, the antenna easier to be matched and higher in radiation efficiency is provided.

Moreover, two antenna elements, i.e., the radiation element 1 and helical element 16, are designed to be operative in deferent bands from each other, respectively, and allow the antenna to be used in a system operative in two different bands.

Embodiment 6

Figure 6:
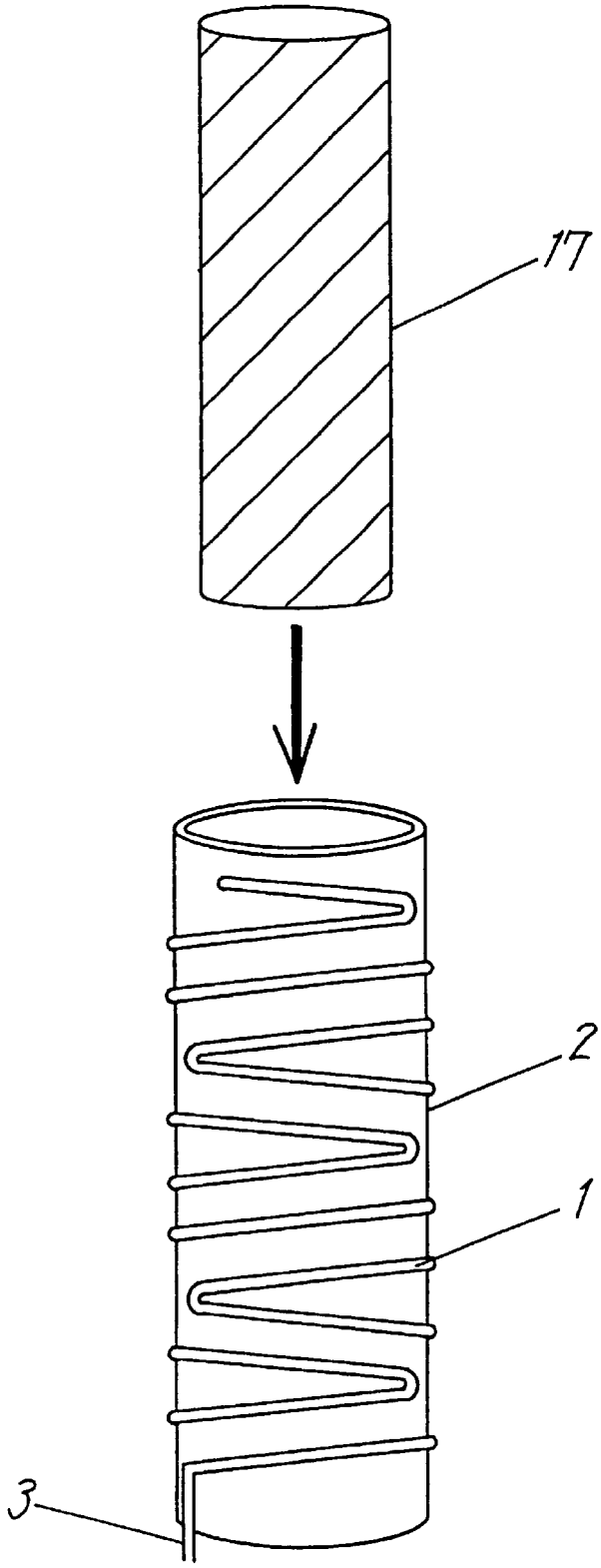
FIG. 6 is an exploded structural diagram of a substantial portion of an antenna according to a sixth exemplary embodiment of the present invention.

FIG. 6 is an exploded structural diagram of a substantial portion of an antenna according to a sixth exemplary embodiment of the present invention. In the figure, a radiation element 1 is formed on the surface of a columnar insulating resin core 2, and a signal is supplied through a current feeding terminal 3 at the lower end of the radiation element 1. The radiation element 1 is wound on the surface of the insulating resin core 2 from the feeding terminal 3 in the winding direction inverted at an arbitrary position.

A columnar hole is formed in the center of the section of the columnar insulating resin core 2, and a cylindrical radiator 17 is disposed at an arbitrary position of the hole with being insulated from the radiation element 1. This cylindrical radiator 17 comprises an insulating film wound on the surface thereof on which the antenna pattern is formed. The radiator is thus installed easily in the radiation element 1 and also adjusts the impedance of the antenna easily.

Moreover, two antenna elements, i.e., the radiation element 1 and radiator 17, are designed to be operable in different bands from each other, respectively, and allow the antenna to be used in a system operable in two different bands.

Embodiment 7

Figure 7:
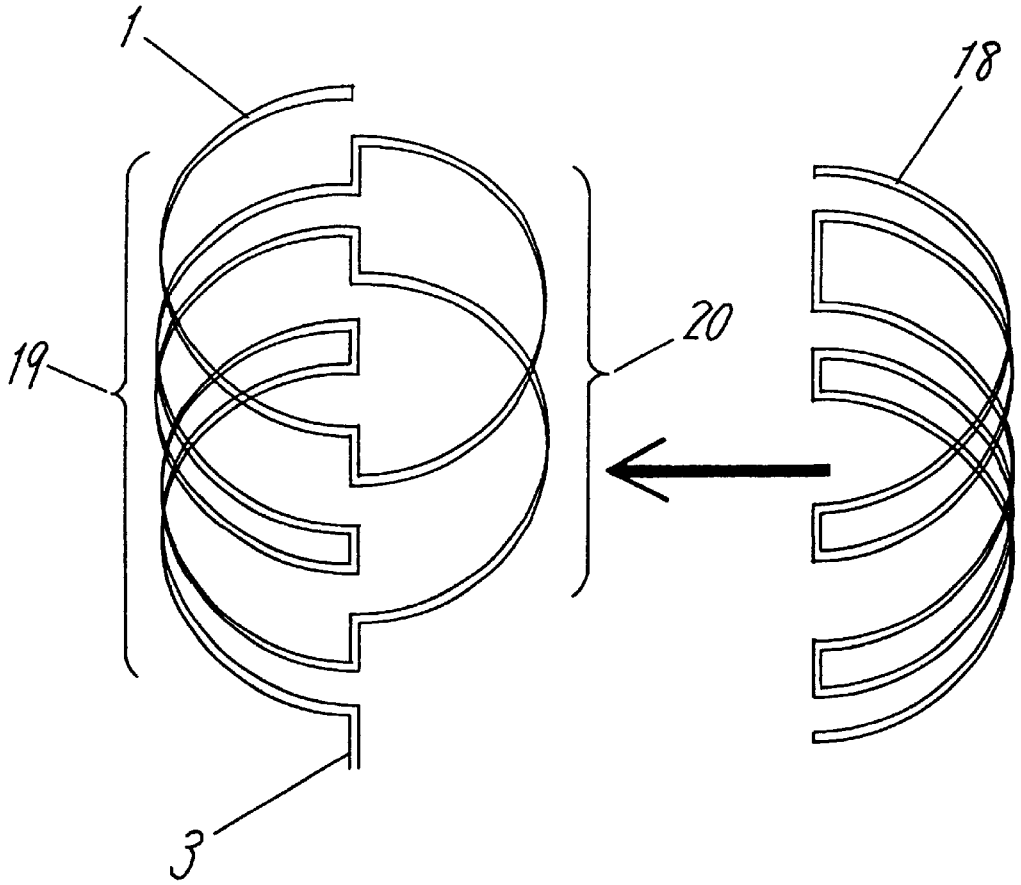
FIG. 7 is an exploded structural diagram of a substantial portion of an antenna according to a seventh exemplary embodiment of the present invention.

FIG. 7 is an exploded structural diagram of a substantial portion of an antenna according to a seventh exemplary embodiment of the present invention. In the figure, the winding direction of a radiation element 1 where an electric signal is supplied through the feeding terminal 3 at the lower end of the element is effectively varied and forming a plane 19 and a plane 20. The plane 19 has a dense pitch of the element, and the plane 20 has a coarse pitch of the element.

For an antenna applicable to two systems, a meander element 18 is disposed on the common surface to the radiation element 1 with being isolated from the radiation element 1. In that case, each pitch of the radiation element 1 and the meander element 18 has to be adjusted, so that the elements substantially in horizontal direction of the radiation element 1 and the meander element 18 may not touch to the plane 20 having a coarse pitch. And therefore, the antenna applicable to a system operable in two different bands is provided without increasing the entire antenna diameter.

Since a broader band width can be obtained with a wider pitch of the antenna, the antenna according to the embodiment where the meander element 18 is disposed on the plane 20 having the coarse pitch presents an excellent antenna characteristic.

Embodiment 8

Figure 8:
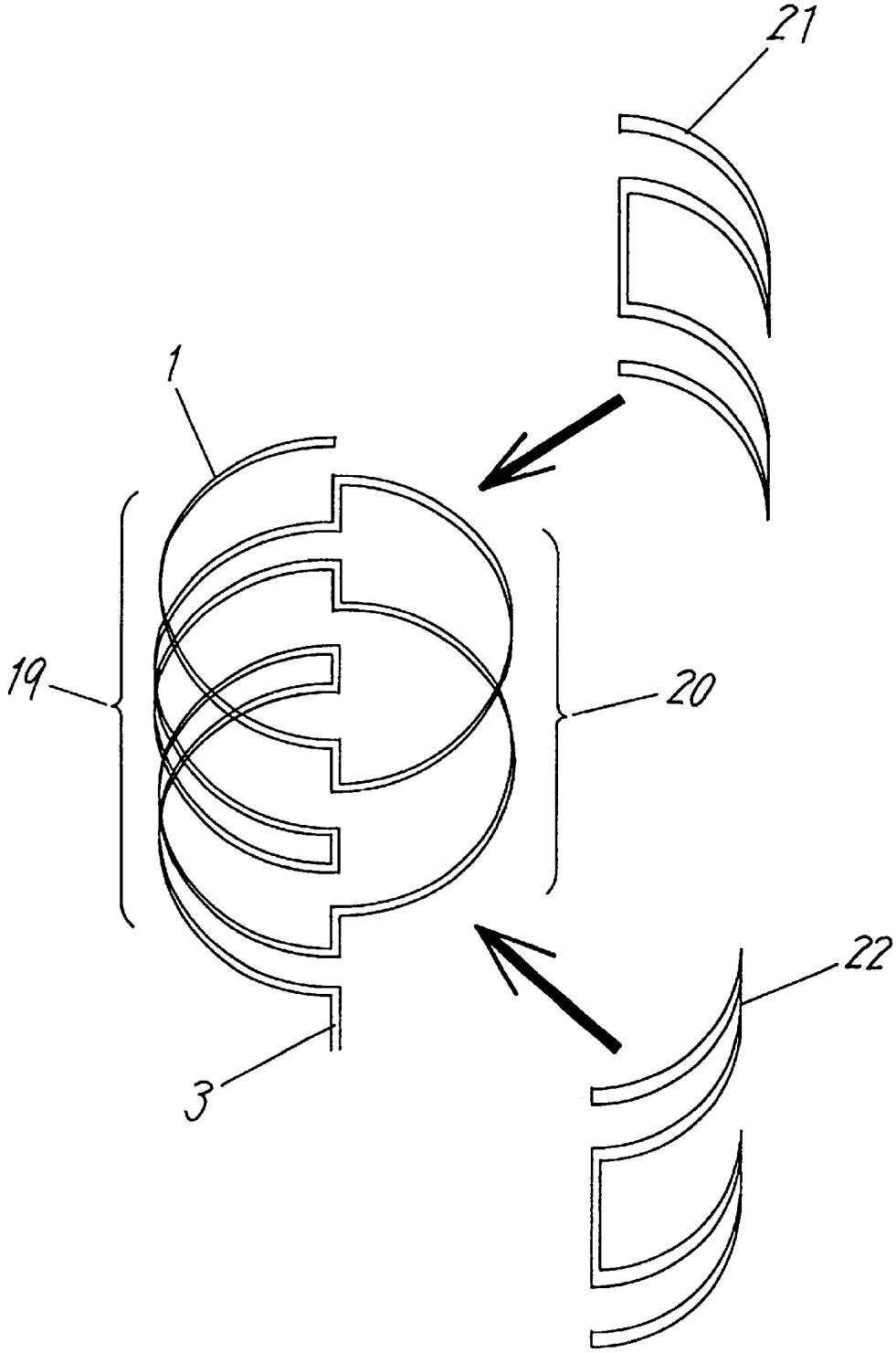
FIG. 8 is an exploded structural diagram of an antenna according to an eighth exemplary embodiment of the present invention.

FIG. 8 is an exploded structural diagram of a substantial portion of an antenna according to an eighth exemplary embodiment of the present invention. In the figure, the winding direction of a radiation element 1 where an electric signal is supplied through the feeding terminal 3 at the lower end of the element is effectively varied and forming a plane 19 and a plane 20. The plane 19 has a dense pitch of the element, and the plane 20 has a coarse pitch For an antenna applicable to three systems, a first meander. element 21 and a second meander element 22 are disposed on the common surface to the radiation element 1 with being mutually insulated. In that case, each pitch of the radiation element 1, the first meander element 21, and the second meander element 22 has to be adjusted, so that the element 21 and element 22 may not touch to the radiation element 1 on the plane 20 having a coarse pitch. And therefore, an antenna applicable to a system operable to three different bands is provided without increasing the entire antenna diameter.

The first meander element 21 and second meander element 22 is disposed on the plane 20 having a coarse pitch. Broadening the pitch as wide as possible presents a broad band width. The number of meander elements disposed on the common surface to the radiation element 1 may more than three. The more elements, the greater is the number of physical parameters of the antenna, and the adjustable range of the impedance characteristic is thus expanded.

In the foregoing fifth to eighth embodiments, In the case that the antenna device usable in a system operable in plural different bands is applied in a communication appliance, a certain radiation element is operated in a receiving band or transmitting band in the communication system, and the other elements is operated in the transmitting band or the receiving band in the communication system. And the feature of the antenna is thus extracted.

That is, a system such as PDC is operated in a lower resonance frequency in the receiving band lower that in the transmitting band. In the system, assigning a short radiation element operable in a lower resonance frequency to the receiving band realizes a desired frequency band with a small-sized antenna. A system such as the AMPS, GSM, or DCS is operated in a lower resonance frequency in the transmitting band lower than that in the receiving band. In the system, assigning a short radiation element capable in a lower resonance frequency to the transmitting band realizes a desired frequency band with a small-sized antenna.

A radiation element may work in a system operated in a low frequency band, and other elements may work in a system operated in a high frequency band. Assigning the radiation element operable in a lower resonance frequency at a shorter element length to the system operated in the low frequency band realizes a desired frequency band with a small-sized antenna.

Embodiment 9

Figure 9:
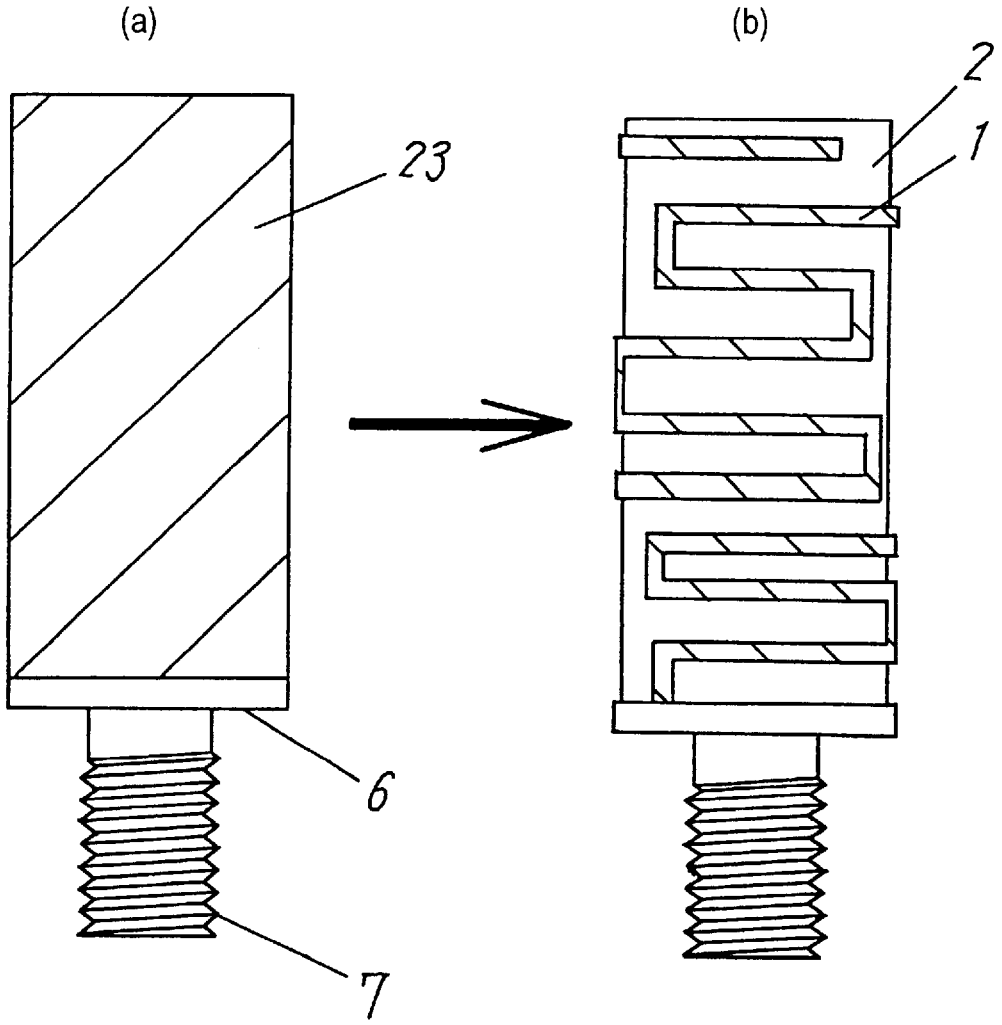
FIG. 9 is a structural diagram for explaining a manufacturing <method of an antenna according to a ninth exemplary embodiment of the present invention.

FIG. 9 is a structural diagram for explaining a method of manufacturing an antenna according to a ninth exemplary embodiment of the present invention. In the figure, a conductive-plated portion 23 applied on the entire surface of an insulating resin core 2 having a circular section and a metal plug 6 disposed at the lower end of the insulating resin core 2 are electrically connected. Under that situation, the conductive plated portion 23 is cut off and removed except for the area required as the radiation element 1, so that the antenna may be small in dimensional fluctuations.

Embodiment 10

Figure 10:
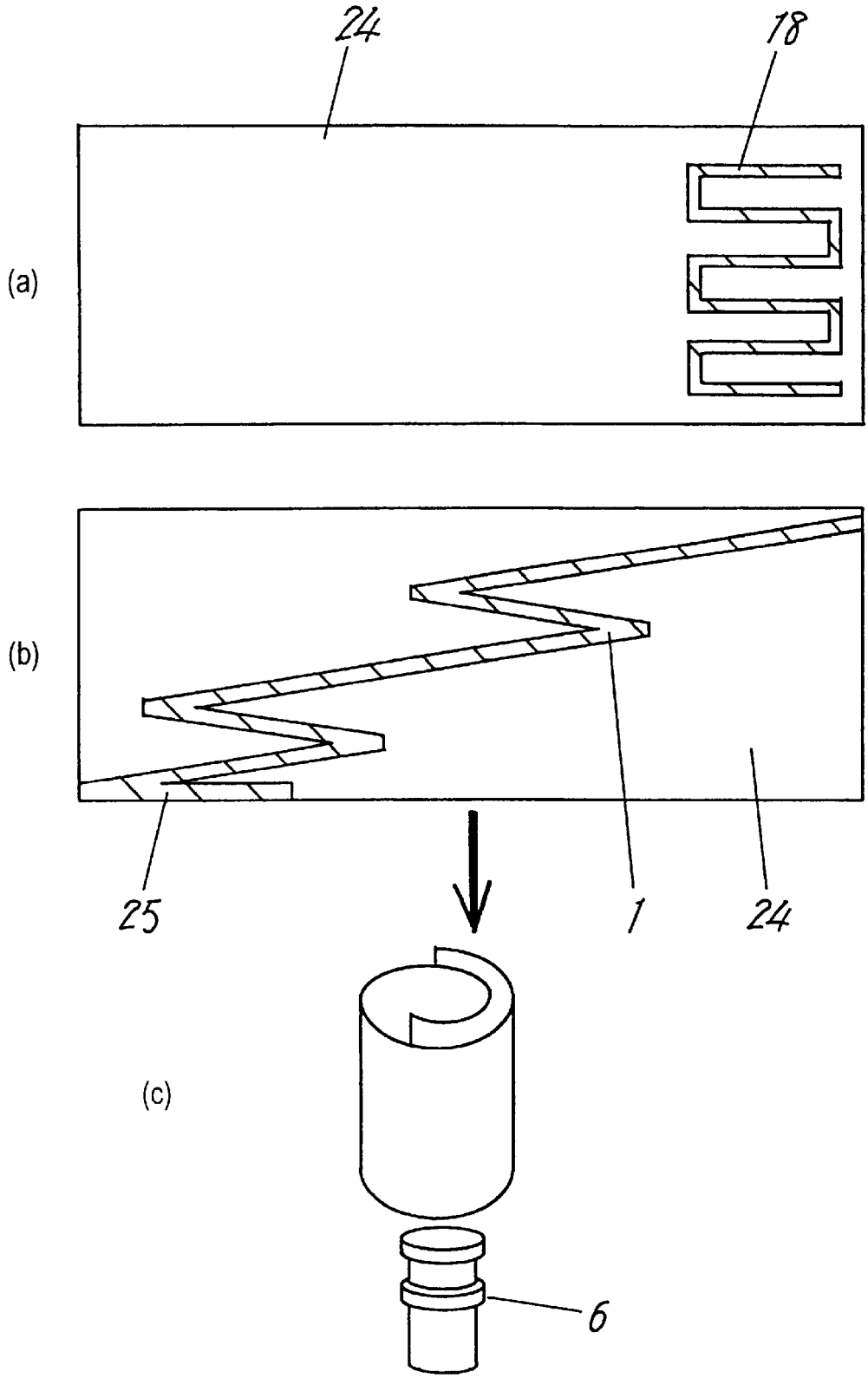
FIG. 10 is a structural diagram for explaining a manufacturing method of an antenna according to a tenth exemplary embodiment of the present invention.
Figure 11:
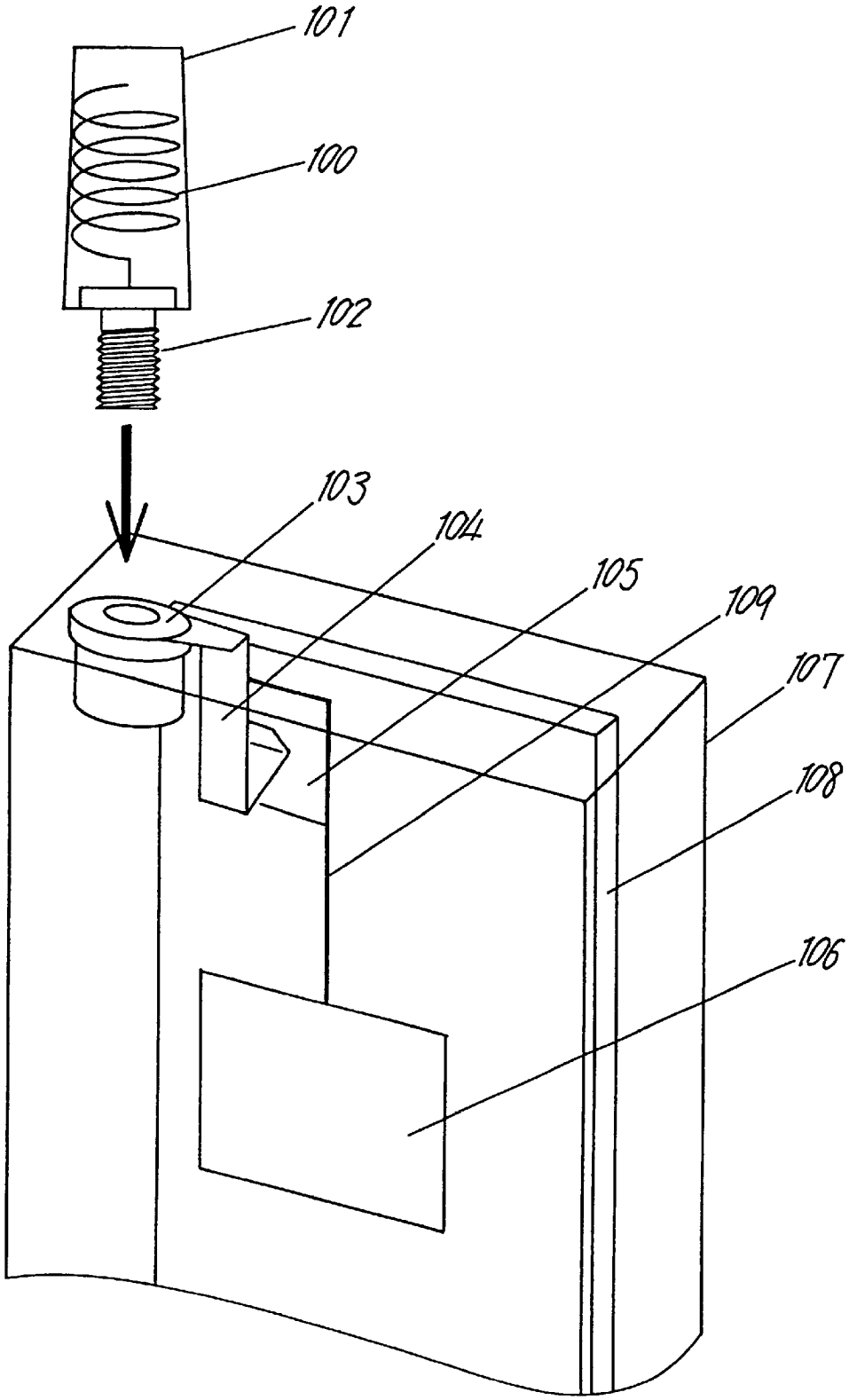
Fig. 11 Prior Art
FIG. 11 is a perspective view of a conventional communication terminal.

FIG. 10 is a structural diagram for explaining a method of manufacturing an antenna according to a tenth exemplary embodiment of the present invention. In the figure, a meander element 18 is formed by plating with a conductive material on the surface of a flexible insulating film 24, and a feeding terminal 25 and a radiation element 1 are formed by plating with a conductive material on another surface.

The flexible insulating film 24 is wound, so that the upper end of a metal plug 6 and the feeding terminal 25 may contact with each other. As a result, the radiation element 1 is disposed in the inside of the antenna, while the meander element 18 is disposed in the outside.

The flexible insulating film 24 used as the antenna easily realizes a small and light antenna easily, and only forming different conductive patterns on the both side of the flexible film easily realizes an antenna usable in a system operable in two different bands.

In the foregoing embodiments, the radiation elements are composed of a conductive metal containing at least one of copper, brass, phosphor bronze, beryllium copper, aluminum, nickel and steel. The copper is used for a high radiation efficiency. The phosphor bronze is used for a high rigidity. The aluminum is used for a lightweight. And therefore, various types of antennas may be realized. And further, selecting the material of the radiation element increases the physical parameters of the antenna, so that the adjustable range of the impedance of the antenna device may be further expanded.

Moreover, plating the surface of the radiation element made of such materials prevents the radiation element from corrosion and thus provides an antenna of which radiation characteristics hardly change in a long term.

What is claimed is:

1. An antenna having a lower end to which a power is fed and an upper end opening electrically, said antenna comprising:

an insulating core;

a radiation element wound spirally around said insulating core, said radiation element having a winding direction which is inverted at at least one position, said radiation element having an impedance characteristic adjustable according to at least one position; and a first meander element insulated from said radiation element, said first meander element and said radiation element not substantially overlapping each other.

2. The antenna of claim 1, wherein the winding direction of said radiation reversed at regular intervals.

3. The antenna of claim 1 further comprising a rib formed every half turn of winding of said radiation element.

4. The antenna of claim 3, wherein said radiation element is formed by a pressing work while said rib supports said radiation element.

5. The antenna of claim 1, wherein a winding pitch of said radiation element changes at at least one portion.

6. The antenna of claim 1, wherein an antenna diameter changes at at least one portion of said radiation element.

7. The antenna of claim 6, wherein the antenna diameter of said radiation element gradually decreases toward the upper end.

8. The antenna of claim 1 further comprising a second meander element insulated from said radiation element.

9. The antenna of claim 1, wherein said radiation element is wound so as to exhibit a dense winding pitch on a first portion of a surface of said insulating core, and a coarse winding pitch on a second portion of the surface of said insulating core, and wherein said first meander element is disposed at the second portion of the surface of said insulating core.

10. The antenna of claim 9, wherein a winding pitch of said radiation element is substantially the same as a winding pitch of said first meander element.

11. The antenna of claim 1, wherein a resonance frequency of said antenna is adjustable by cutting an element length of said radiation element from an end of said radiation element.

12. The antenna of claim 1, wherein said radiation element comprises a conductive metal including at least one of copper, brass, phosphor bronze, beryllium copper, aluminum, nickel, and steel.

13. The antenna of claim 12, wherein a surface of said radiation element is plated.

14. The antenna of claim 1, wherein said insulating core is plated to form a conductive surface, and wherein said radiation element comprises a conductive pattern formed by removing an unnecessary portion as said radiation element from the conductive surface.

15. The antenna of claim 1 further comprising a flexible film wound cylindrically, wherein said radiation element comprises a first conductive pattern formed on a first side of said flexible film.

16. The antenna of claim 15, said first conductive pattern is formed by plating.

17. The antenna of claim 15 further comprising a second conductive pattern formed on a second surface of said flexible film, wherein said first and second conductive patterns are different from each other.

18. The antenna of claim 8, wherein said first meander element, said second meander element and said radiation element are all formed on a same surface of said insulating core, said first meander element, said second meander element and said radiation element being configured such that said first meander element, said second meander element and said radiation element do not contact one another.

19. The antenna of claim 9, wherein said first meander element and said radiation element do not contact one another.

20. A communication terminal operable in a communication system, said communication terminal comprising an antenna having a lower end to which a power is fed and an upper end opening electrically, said antenna including:

an insulating core;

a radiation element wound spirally around said insulating core, said radiation element having a winding direction which is inverted at at least one position, said radiation element having an impedance characteristic adjustable according to said at least one position; and a first meander element insulated from said radiation element, wherein said radiation element operates in a first band in said communication system, and said first meander element operates in a second band in said communication system.

21. The communication terminal of claim 20, wherein the first band is a transmitting band in said communication system, and wherein the second band is a receiving band in said communication system.

22. The communication terminal of claim 20, wherein the first band is a receiving band in said communication system, and wherein the second band is a transmitting band in said communication system.

23. A communication terminal comprising an antenna having a lower end to which a power is fed and an upper end opening electrically, said antenna including:

an insulating core;

a radiation element wound spirally around said insulating core, said radiation element having a winding direction which is inverted at at least one position; said radiation element having an impedance characteristic adjustable according to said at least one position; and a first meander element insulated from said radiation element, wherein said radiation element operates in a first frequency band, and said first meander element operates in a second frequency band.

24. The communication terminal of claim 23, wherein the first frequency band is lower than the second frequency band.

25. An antenna having a lower end to which a power is fed and an upper end opening electrically, said antenna comprising:

an insulating core;

a radiation element wound spirally around said insulating core, said radiation element having an impedance characteristic, said radiation element having a winding direction which is inverted at a plurality of positions so as to adjust said impedance characteristic of said radiation element; and a first meander element insulated from said radiation element.

26. A communication terminal operable in a communication system, said communication terminal comprising an antenna having a lower end to which a power is fed and an upper end opening electrically, said antenna including:

an insulating core;

a radiation element wound spirally around said insulating core, said radiation element having an impedance characteristic, said radiation element having a winding direction which is inverted at a plurality of positions so as to adjust said impedance characteristic of said radiation element; and a first meander element insulated from said radiation element, wherein said radiation element operates in a first band in said communication system, and said first meander element operates in a second band in said communication system.

* * * * *